US007066422B1

(12) United States Patent
Slocum

(10) Patent No.: US 7,066,422 B1
(45) Date of Patent: Jun. 27, 2006

(54) AXIAL CENTER DISPENSING PLASTIC SHEET ROLL AND METHOD OF USE

(75) Inventor: Tracy Lee Slocum, Allison, IA (US)

(73) Assignee: Waverly Plastics, Waverly, IA (US)

( * ) Notice: Subject to any disclaimer, the term of this patent is extended or adjusted under 35 U.S.C. 154(b) by 1 day.

(21) Appl. No.: 10/357,674

(22) Filed: Feb. 4, 2003

(51) Int. Cl.
*B65H 75/28* (2006.01)
*B65H 18/28* (2006.01)

(52) U.S. Cl. ..... 242/593; 242/160.4; 242/167; 242/528

(58) Field of Classification Search ..... 242/160.4, 242/167, 528, 593; 493/178, 194, 196, 197, 493/199, 200, 202, 208, 231, 341, 446, 455, 493/359, 360, 403, 434, 442; 53/118, 119
See application file for complete search history.

(56) References Cited

U.S. PATENT DOCUMENTS

| | | | | |
|---|---|---|---|---|
| 1,819,122 | A * | 8/1931 | Resnati | 242/593 |
| 4,034,928 | A | 7/1977 | McDonald et al. | |
| 4,597,494 | A | 7/1986 | Benoit | |
| 4,688,368 | A * | 8/1987 | Honegger | 242/528 |
| 4,824,425 | A * | 4/1989 | Stock | |
| 4,938,608 | A * | 7/1990 | Espinosa | |
| 5,301,889 | A * | 4/1994 | Ball | 242/593 |
| 5,474,208 | A * | 12/1995 | Ball | 242/593 |
| 5,582,362 | A * | 12/1996 | Johnson et al. | 242/593 |
| 5,609,269 | A | 3/1997 | Behnke et al. | |
| 5,619,840 | A * | 4/1997 | Nyman et al. | 53/118 |
| 5,776,289 | A * | 7/1998 | Steidinger | |
| 6,168,558 | B1 * | 1/2001 | Vinberg | 493/196 |
| 6,186,436 | B1 | 2/2001 | Selle et al. | |
| 2002/0030135 | A1 | 3/2002 | Bartels et al. | |

OTHER PUBLICATIONS

Waverly Plastics promotional material, pp. 15-16, the "Savvy Sak" High Density Liners with coreless roll configuration and interleaved design for "one-at-a-time" dispensing convenience.

Shelton, Scott; *Effects, Theory and Control of Static Electricity*, reprinted from *Best's Safety Directory*, 1982 by SIMCO, An Illinois Tool Works Company.

McMaster-Carr catalog pp. 1513-1514, Polyethylene Compactor Bags, Tear-Resistant Polyethylene Bags, Ployethylene Draw-Tape Bags, Polyethylene Hazardous Material and Biohazard Bags, Polyethylene Bags are offered in either perforated rolls or folded for dispensing; p. 1515, Recycled Plastic Bags.

(Continued)

*Primary Examiner*—William A. Rivera
(74) *Attorney, Agent, or Firm*—McKee, Voorhees & Sease, P.L.C.

(57) ABSTRACT

An axial center plastic sheet roll with a coreless roll of multiple, discrete consecutive plastic sheets with an area of overlap on each other in the circumferential direction of the roll such that opposite edges of the sheets in sum total define the opposite ends of the roll. The plastic sheets at the area of overlap possess an electrostatic bond connecting the plastic sheets to one another. The sheets are dispensable from within the center of the roll in the axial direction such that removal of one sheet partially removes the next consecutive sheet. A method of dispensing including dispensing the products from within the center of the roll such that removal of one sheet partially removes the next consecutive sheet.

13 Claims, 5 Drawing Sheets

OTHER PUBLICATIONS

Grainger catalog p. 2075 Specialty Trash Can Liners; p. 2076, ROL-OUT® Coreless Roll Liners and Tough Guy® Trash Can Liners; and p. 2077 ROL-OUT® Coreless Roll Liners and Tough Guy® Linear Low Coreless Roll & Flat Pack Can Liners.

Lab Safety Supply catalog pp. 2084-2086 Mobil® Low Density Can Liners, Heavey-Duty Waste Bags, HDPE Can Liners, Rubbermaid® Coreless Roll Polyliners, Low Density White Can Liners, 6-Mil, Extra-Tough Bags, Mobil® Hefty® Steel Sak® Liners, Clear Can Liners, Poly Drum Liners.

*Industrial Material Handling and Industrial Catalog*, Big River Equipment Co., Inc. 2002 Fall/Winter Catalog No. 209; Index: 368; p. 229 Poly Bags; p. 234, EconoMizer® Wipers and Scottcloth® Heavy-Duty Wipers with central top dispensing.

* cited by examiner

AXIAL CENTER DISPENSING PLASTIC SHEET ROLL AND METHOD OF USE

BACKGROUND OF THE INVENTION

The present invention relates to the field of rolled plastic sheet rolls. More particularly, this invention relates to plastic bags, such as plastic trash bags and grocery bags, that may be packaged in rolls and dispensed from their axial center. The invention also relates to the method of dispensing the plastic sheets from their rolls.

Plastic bags are bulky and must be folded or rolled for packaging and transportation. For example, a typical 24" wide by 24" high plastic bag has a 7 to 10 gallon capacity when filled. Therefore, plastic bags are typically folded to reduce the width in half or a quarter of the original size, folded or rolled, and then stored in a packaging for transportation and dispensing. Plastic bags have, in the past, been stored together or individually.

When plastic bags are stored together they have been typically stored in rolls with perforations. When plastic bags are stored with perforations, a first plastic bag is joined to a second plastic bag but a seam exists with perforations such that the two plastic bags may be separated from one another. This creates problems though, because when the plastic bags are dispensed from the circumferential or from axial center the next plastic bag is difficult to find because a user has to search for the perforations. In addition, once a user does find the perforations, the user must pull the two bags apart from one another. Therefore, a primary objective of the present invention is to provide a center pull out axial center dispensing plastic sheet roll in which the plastic sheets are separated without perforations thus eliminating the need to hunt for perforations or the need to manually separate two plastic bags from one another.

Plastic bags without perforations have also been stored individually in a folded configuration upon each other. This requires the user to dig within a carton for a bag. In addition, a user may pull out more than one bag rather than just an individual bag. Therefore, a further objective is to provide for dispensing the plastic bags individually and accessibly outside of a dispenser.

Also previously known in the art is the method of electrostatically charging plastic bags so that they may form a coreless roll. Dispensing from the circumferential direction requires that a user manually handle a plastic sheet roll as opposed to having it within a dispenser. In this configuration, the user must use both hands and spin the roll until the end of the plastic sheet is reached. Therefore, a further objective is the provision of a plastic sheet roll that may be dispensed without unrolling the plastic sheets.

A still further objective of the present invention is the provision of a plastic sheet roll that can be quickly and easily dispensed.

A still further objective is a means which permits gripping of the plastic sheets when they are not being dispensed.

Another objective of the present invention is the provision of a sheet roll dispenser which is economical to produce, durable, and reliable in use.

These and other objectives will be apparent from the drawings and description.

BRIEF SUMMARY OF THE INVENTION

The foregoing objectives may be achieved with an axial center dispensing plastic sheet roll of multiple, discrete, consecutive, plastic sheets with an area of overlap on each other in the circumferential direction of the roll such that opposite edges of the sheets in sum total define the opposite ends of the roll. The plastic sheets have an electrostatic bond connecting the sheets to one another at the area of overlap. The sheets are dispensable from within the center of the roll in the axial direction such that removal of one sheet partially removes the next consecutive sheet.

The foregoing objective may also be achieved by an axial center dispensing plastic sheet roll product having a dispensing carton. Within the dispensing carton is a coreless roll of multiple, discrete, consecutive, plastic sheets which overlap each other in the circumferential direction of the roll such that opposite edges of the sheets in sum total define the opposite ends of the roll within the dispensing carton. The plastic sheets have an electrostatic bond connecting the sheets to one another. The sheets are dispensable from within the center of the roll in the axial direction such that removal of one sheet partially removes the next consecutive sheet. An opening in the dispensing carton allows the sheets to be axially dispensed.

The foregoing objectives may also be a method of dispensing plastic sheets which utilizes a dispensing carton and a coreless roll of multiple, discrete, consecutive, plastic sheets with an area of overlap on each other in the circumferential direction of the roll such that opposite edges of the sheets in sum total define the opposite ends of the roll within the dispensing carton. The plastic sheets have an electrostatic bond connecting the sheets to one another at the area of overlap. The dispenser has an opening with a notch in the dispensing carton through which the sheets may be axially dispensed. The method consists of dispensing the product from within the center of the roll in the axial direction the removal of one sheet partially removes the next consecutive sheet.

DETAILED DESCRIPTION OF THE PREFERRED EMBODIMENT

Figure 1:
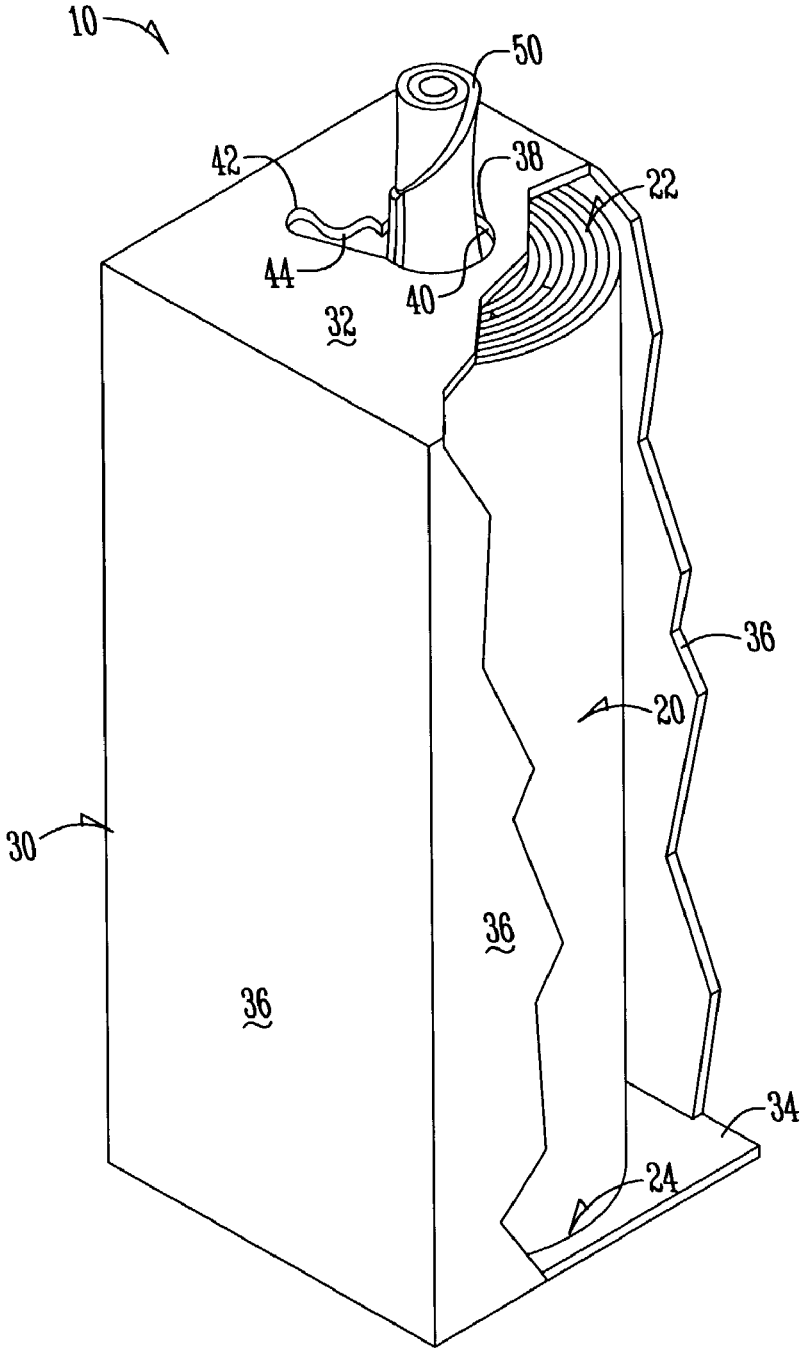
FIG. 1 is a perspective view of the axial center dispensing plastic sheet roll with a dispenser partially cut away to show the plastic sheet roll contained with the first plastic sheet pulled from within.

As seen in FIG. 1, the axial center dispensing plastic sheet roll and dispenser 10 has a plastic sheet roll 20 and a dispenser carton 30.

The plastic sheet roll 20 has a dispensing end 22 and a non-dispensing end 24. The dispensing end 22 and non-dispensing end 24 are at opposite ends of the plastic sheet roll 20. The dispenser 30 has a dispensing end 32 and a non-dispensing end 34. Side walls 36 connect the non-dispensing end 34 to the dispensing end 32.

The dispenser 30 is a rectangular box as seen in FIG. 1. Alternatively, the dispenser 30 may be shaped as a hexagonal box. Alternatively, other box shapes known in the art may be used to contain the plastic sheet roll 20.

The dispenser 30 has a first inner periphery 38 defining a first opening 40, located upon the dispensing end 32. The dispenser 30 also has a second inner periphery 42 defining a second opening or notch 44, located upon the dispensing end 32.

In use, the plastic sheet roll dispensing end 22 is in axial alignment with the dispenser dispensing end 32. A plastic sheet or plastic layer 50 is pulled through the first opening 40. The first opening 40 is sized to permit a plastic sheet 50 to be completely withdrawn from within the dispenser 30. The notch 44 allows a portion of the plastic sheet 50 to be placed within it to prevent the plastic sheet 50 from moving into the dispenser 30 once it has been withdrawn to a desired position outside of the dispenser 30.

Figure 2:
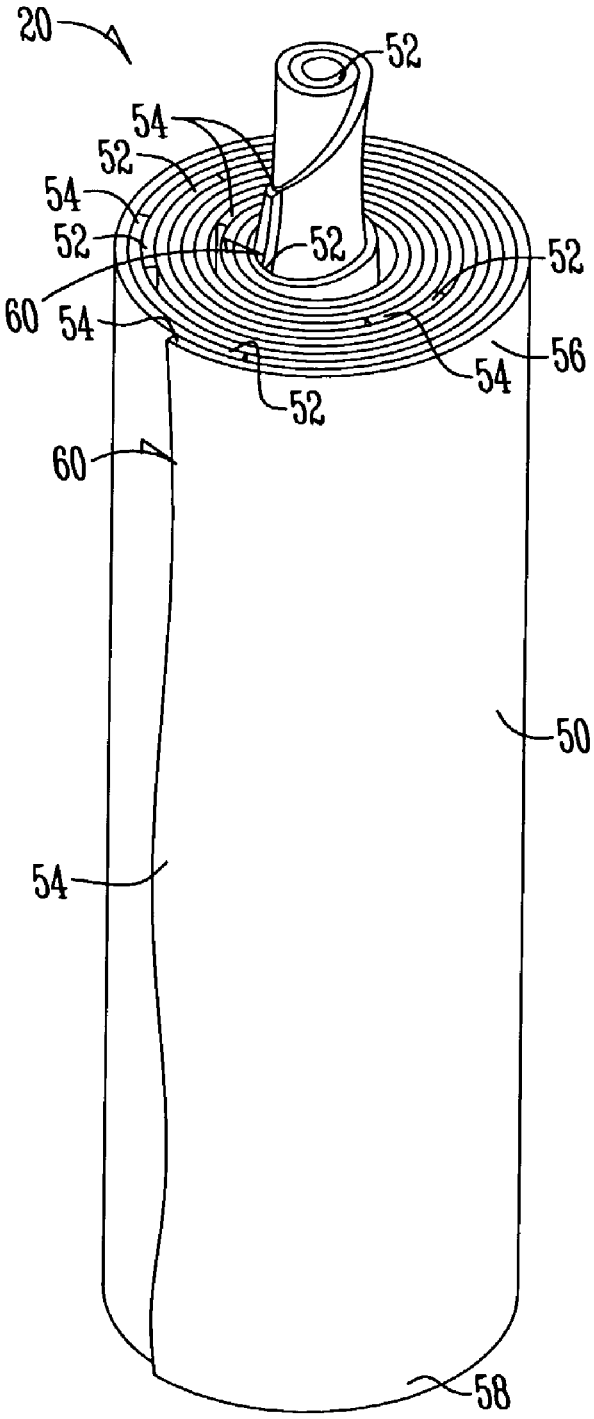
FIG. 2 is a perspective view of the axial center dispensing plastic sheet roll showing the overlap between the individual sheets and a plastic sheet being removed from the top.

As seen in FIG. 2, the plastic sheet roll 20 is a coreless roll of multiple, discrete, consecutive, plastic sheets 50 which overlap each other in the circumferential direction of the roll such that the opposite edges of the sheets in sum total define the opposite ends 22, 24 of the roll 20. The discrete plastic sheets 50 have a first end 52 and a second end 54. The plastic sheets 50 also have a dispensing side 56 and a non-dispensing side 58. The plastic sheets 50 have an overlap area 60. The overlap area 60 is defined as a point of overlap between the first end 52 and the second end 54. The first end 52 and the second end 54 overlap each other in the circumferential direction of the roll 20. The plastic sheets 50 when they are in a roll 20 have the dispensing side 56 and the non-dispensing side 58 in sum total define the opposite edges of the roll 22, 24.

Figure 4:
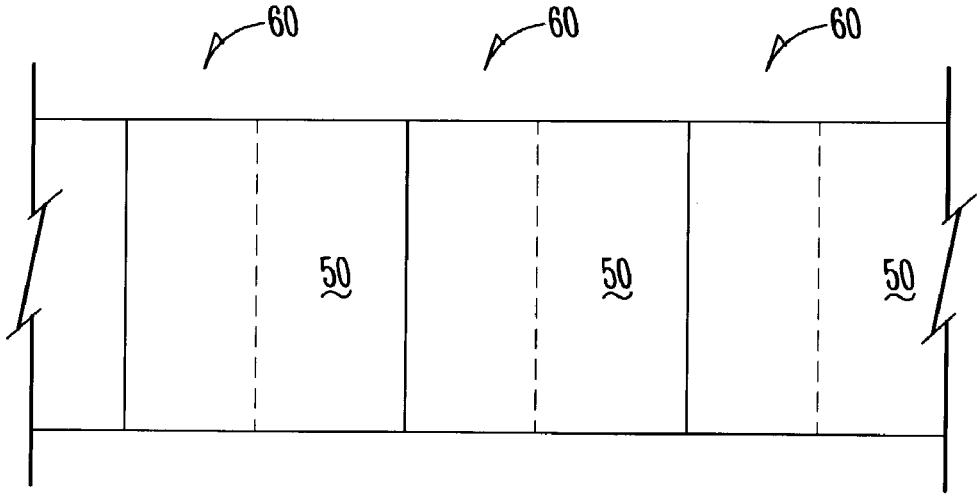
FIG. 4 is a fragmentary top plan view of a series of plastic sheets showing the sheets aligned with overlap between the plastic sheets.
Figure 5:
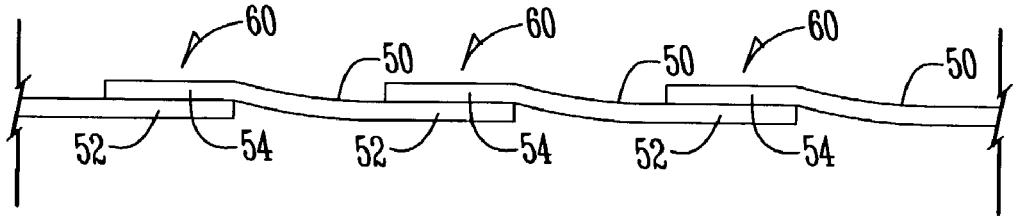
FIG. 5 is a side view of FIG. 4 showing the overlap between the plastic sheets.

The plastic sheets 50 are held to one another at the overlap area 60. The overlap area 60 may vary in width; however, preferably, the overlap area is regular in width. The plastic sheets 50 are held together by an electrostatic bond. As shown in FIGS. 4 & 5, the discrete, consecutive plastic sheets 50 are placed such that they overlap each other. The overlap of these sheets 50 is preferably within the range of 4" to 6".

There may also be an electrostatic charge upon the area of the plastic sheet 50 that is not part of the overlap area 60. This electrostatic charge aids in maintaining the integrity of the roll shape.

Initially, the plastic sheets 50 are not statically charged. Without a static charge, the plastic sheets 50 will not cling to one another. Without this connection, the plastic sheets 50 will slip off one another and not serve the function of being able to be pulled from the axial center of a coreless roll 20. An electrostatic charge may be placed upon the plastic sheets 50 through a static pinner 74. Alternatively, an electrostatic charge may be placed upon the plastic sheets 50 through friction inherent in the plastic sheet 50 by processing.

Figure 6:
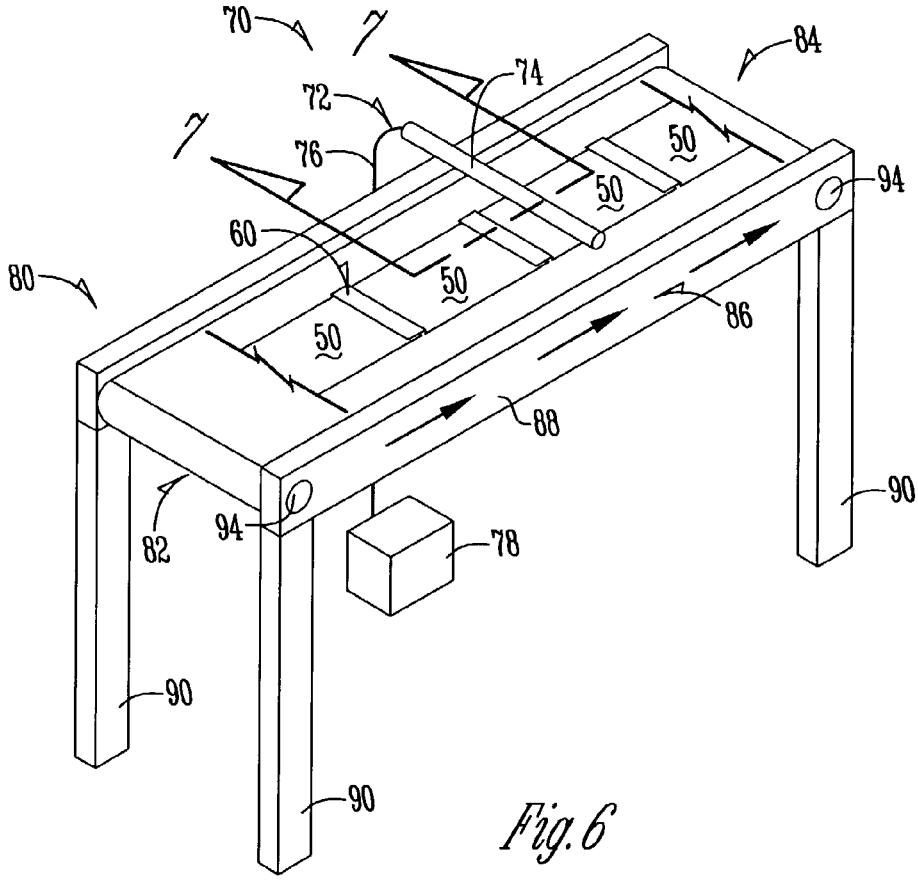
FIG. 6 is a perspective view of the process of statically charging the plastic sheets with a static pinner.

As seen in FIG. 6, the plastic sheets 50 may be run upon a grounded surface or conveyer 80 underneath a static pinner 74 in order to incorporate an electrostatic charge. The conveyor 80 provides a grounding for the static pinner 74.

Figure 7:
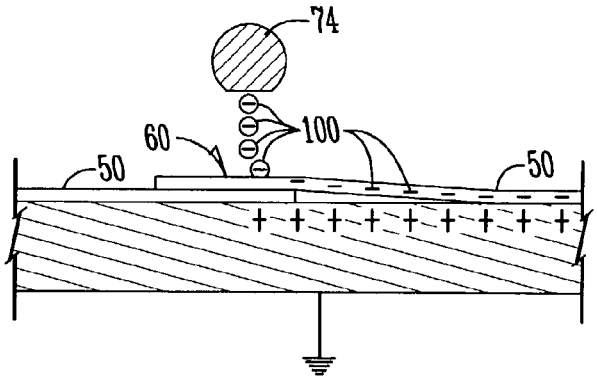
FIG. 7 is a cross sectional view taken along Line 6—6 in FIG. 5 showing the placement of electrons from the static pinner onto the plastic sheets.

FIG. 6 and FIG. 7 shows a processor 70 for electrostatically charging plastic sheets 50. The processor 70 uses electrostatic generating equipment 72 placed upon a conveyor 80. As the conveyor 80 moves underneath the electrostatic generating equipment 72 a static pinner 74 emits electrons 100 that move from the static pinner 74 and onto the conveyor 80. The plastic sheets 50 are insulators and therefore, the electrostatic charge placed upon the plastic sheets 50 remains in place on the plastic sheets 50.

The electrostatic generating equipment 72 consists of a static pinner 74 which emits electrons 100. The static pinner 74 is connected with a conductor 76 to an electric control box 78. The electric control box 78 provides electricity to the static pinner 74. The electric control box 78 provides an on/off switch to the static pinner 74 as well as generates operating voltage to the static pinner 74 at a preferred rate between 10 kV and 25 kV. The operating voltage to the static pinner 74 is dependant upon the amount of electrostatic charge required by the plastic sheets 50 within variable environmental conditions such as humidity and the variable insulative quality of the materials used to make the plastic sheets 50. Under certain humidity and processing conditions, the operating voltage of the static pinner 74 may be 0 kV or turned off. Thus, the product relies upon operating voltage inherent in the plastic sheet processing.

In the preferred embodiment, the electric control box 78 is a Simco SCH-30 negative DC generator. This generator provides a negative polarity output of 30 kV. The electric control box 78 has a variable switch that provides kilovolts to the static pinner at a rate of between zero and thirty kilovolts. Other models of static pinners are available. It is anticipated that any kilovolt rating of DC generator may be used. Preferably, the DC generator output is kilovolt variable. It is also anticipated that the polarity of the static pinner may be either negative or positive.

The electrostatic generating equipment 72 is attached to conveyor 80. The conveyor 80 has a first end 82 and a second end 84. The plastic sheets 50 are placed upon the conveyor 80 at a first end 82. The device for placing the plastic sheets 50 upon the conveyor 80 is immaterial to the present invention, and not shown. The plastic bags travel along the conveyor 80 to a second end 84 where they are removed by a rolling device. The rolling device operates to create a plastic sheet roll 20 with clockwise alignment of plastic sheets 50. Alternatively, the rolling device operates to create a plastic sheet roll 20 with counterclockwise alignment of plastic sheets 50. The rolling device is immaterial to the present invention and is not shown.

The conveyor 80 has a conveyor frame 86. The conveyor frame 86 has a body 88 and legs 90. The conveyor 80 turns a conveyor line 92 about axels 94.

As seen in FIG. 7, the static pinner 74 emits electrons 100. The electrons 100 create a charge upon the plastic sheets 50. This charge travels with the plastic sheets 50 as it moves along with the conveyor line 92. This charge remains upon the plastic sheets 50 while it is on the conveyor line 92 effectively pinning the plastic sheet 50 to the conveyor line 92 as it is running upon the grounded surface or conveyor 80. The electrons 100 also pin the individual sheet layers 50 to each other. When the plastic sheets 50 are removed from the conveyor 80, an electrostatic charge remains upon the plastic sheets 50 bonding the plastic sheets 50 together at the overlap area 60. With this electrostatic charge, the plastic sheets 50 may be rolled into a plastic sheet roll 20 without the plastic sheets 50 separating.

The plastic sheets 50 used for this process may be made of high-density polyethylene (HDPE). The plastic sheets 50 may also be low linear density polyethylene (LLDPE). Alternative plastics well known in the art may be used. Plastic is an insulator. Within an insulator the flow of electrons is limited; because of this, an insulator may retain several static charges of different potentials and polarities at various areas on its surface. Connecting the insulator to ground will not release the electrostatic charge.

Specifically, the plastic sheets 50 anticipated to be used for this product are plastic bags. The specific plastic bags may be seen in Table 1 and Table 2 below. Table 1 and Table 2 encompass a variety of plastic bags and sizes, roll count, roll diameter, roll height, and thickness. Table 1 refers to Waverly Plastic Item numbers divided by high density polyethylene (HDPE). Table 2 refers to Waverly Plastic Item numbers divided by low linear density polyethylene (LLDPE). As the plastic layers 50 move beneath the static pinner 74, they are charged up to the output voltage of the static pinner 74. This creates a potential difference between the plastic sheets 50 and the grounding surface. It is this electrostatic charge that is the bonding action. The duration of the bonding action between the plastic sheets 50 depends upon such factors as humidity, insulative quality of the materials and subsequent processes.

TABLE 1

High Density Polyethylene (HDPE) Waverly Plastic Items

| Item No. | Size Width | Size Height | New Roll Count | Roll Dia. | Case Wt. | Roll Ht. | GAL. CAP. | COLOR | Mic./Mil |
|---|---|---|---|---|---|---|---|---|---|
| T242406N | 24 | 24 | 250 | 3.9" | 2.35 | 6 | 7–10 | CLEAR | 6 mic. |
| T243106N | 24 | 31 | 250 | 4.35 | 3.03 | 6 | 8–10 | CLEAR | 6 mic. |
| T304410N | 30 | 44 | 125 | 4.7" | 4.37 | 7.5 | 20 | CLEAR | 10 mic. |
| T334614N | 33 | 46 | 100 | 5" | 5.67 | 8.25 | 32 | CLEAR | 14 mic. |
| T375214N | 37 | 52 | 75 | 4.7" | 5.39 | 9.25 | 44 | CLEAR | 14 mic. |
| T375217N | 37 | 52 | 75 | 5.15" | 6.57 | 9.25 | 44 | CLEAR | 17 mic. |
| T434816N | 43 | 48 | 75 | 4.8" | 6.63 | 10.75 | GLT | CLEAR | 16 mic. |
| T445714N | 44 | 57 | 75 | 4.9" | 7.03 | 11 | 56 | CLEAR | 14 mic. |
| T445717N | 44 | 57 | 50 | 4.4" | 5.71 | 11 | 56 | CLEAR | 17 mic. |
| T445722N | 44 | 57 | 50 | 5" | 7.42 | 11 | 56 | CLEAR | 22 mic. |

TABLE 2

Low Linear Density Polyethylene (LLDPE) Waverly Plastic Items

| Item No. | Size Width | Size Height | New Roll Count | Roll Dia. | Case Wt. | Roll Ht. | GAL. CAP. | COLOR | Mic./Mil |
|---|---|---|---|---|---|---|---|---|---|
| TL242305K | 24 | 23 | 200 | 4.8" | 3.68 | 6 | 7–10 | BLACK | .5 mil. |
| TL243005K | 24 | 30 | 150 | 4.8" | 3.6 | 6 | 8–10 | BLACK | .5 mil. |
| TL304308K | 30 | 43 | 75 | 5.1" | 5.16 | 7.5 | 20 | BLACK | .8 mil. |
| TL334510K | 33 | 45 | 50 | 4.8" | 4.95 | 8.25 | 32 | BLACK | 1.0 mil. |
| TL334514K | 33 | 45 | 25 | 4" | 3.46 | 8.25 | 32 | BLACK | 1.4 mil. |
| TL375010K | 37 | 50 | 50 | 5" | 6.16 | 9.25 | 44 | BLACK | 1.0 mil. |
| TL375014K | 37 | 50 | 25 | 4.2" | 4.31 | 9.25 | 44 | BLACK | 1.4 mil. |
| TL434714K | 43 | 47 | 25 | 4.1" | 4.71 | 10.75 | GLT | BLACK | 1.4 mil. |
| TL445510K | 44 | 55 | 25 | 3.7" | 4.03 | 11 | 56 | BLACK | 1.0 mil. |
| TL445517K | 44 | 55 | 25 | 4.9" | 6.86 | 11 | 56 | BLACK | 1.7 mil. |

With the products in Table 1 and Table 2 the plastic sheets 50 are folded twice to create a cross section having four sheet layers 50 also describable as eight plastic sheet layers 50.

As seen in FIG. 2, the plastic sheets 50 may be wound to encircle axial center multiple times. Alternatively, the plastic sheets 50 may be wound to encircle axial center once. Still alternatively, the plastic sheets 50 may partially circle axial center.

In operation, the statically charged plastic sheet roll 20 may come to the consumer within a dispenser 30. A user removes any obstruction that may be placed upon the dispensing end 32 of the dispenser 30 such as a closure to the first opening 40 and the second opening 44. The user then reaches within the carton 30 to pull out a plastic sheet 50. The user then pulls the plastic sheet 50 into and out of the first opening 40. The movement of the plastic sheet 50 out of the first opening 40 pulls out the entire plastic sheet 50 that is attached until non-dispensing side 58 of the plastic sheet 50 and the plastic sheet second end 54 is reached. Electrostatically bonded to this second end 54 is a second plastic sheet 50 attached to the second end 54 by the first end 52. As seen in FIG. 1, the user then removes the first plastic sheet 50 from the second plastic sheet 50 by clasping the second plastic sheet 50 and pulling with such a force to overcome the electrostatic charge bonding the two plastic sheets 50 together at the overlap area 60.

Alternatively, the user pulls out the first plastic sheet 50 until the user identifies an increased force resulting from a first plastic sheet and a second plastic sheet exiting the dispenser together. The increased force stems from the overlap area 60 creating increased frictional force against opening 40. The user may then place the second plastic sheet 50 into the notch 44 and pull the first plastic sheet 50. Alternatively, the user may pull the first sheet with one hand at such a force to overcome the bond at the overlap area 60.

Figure 3:
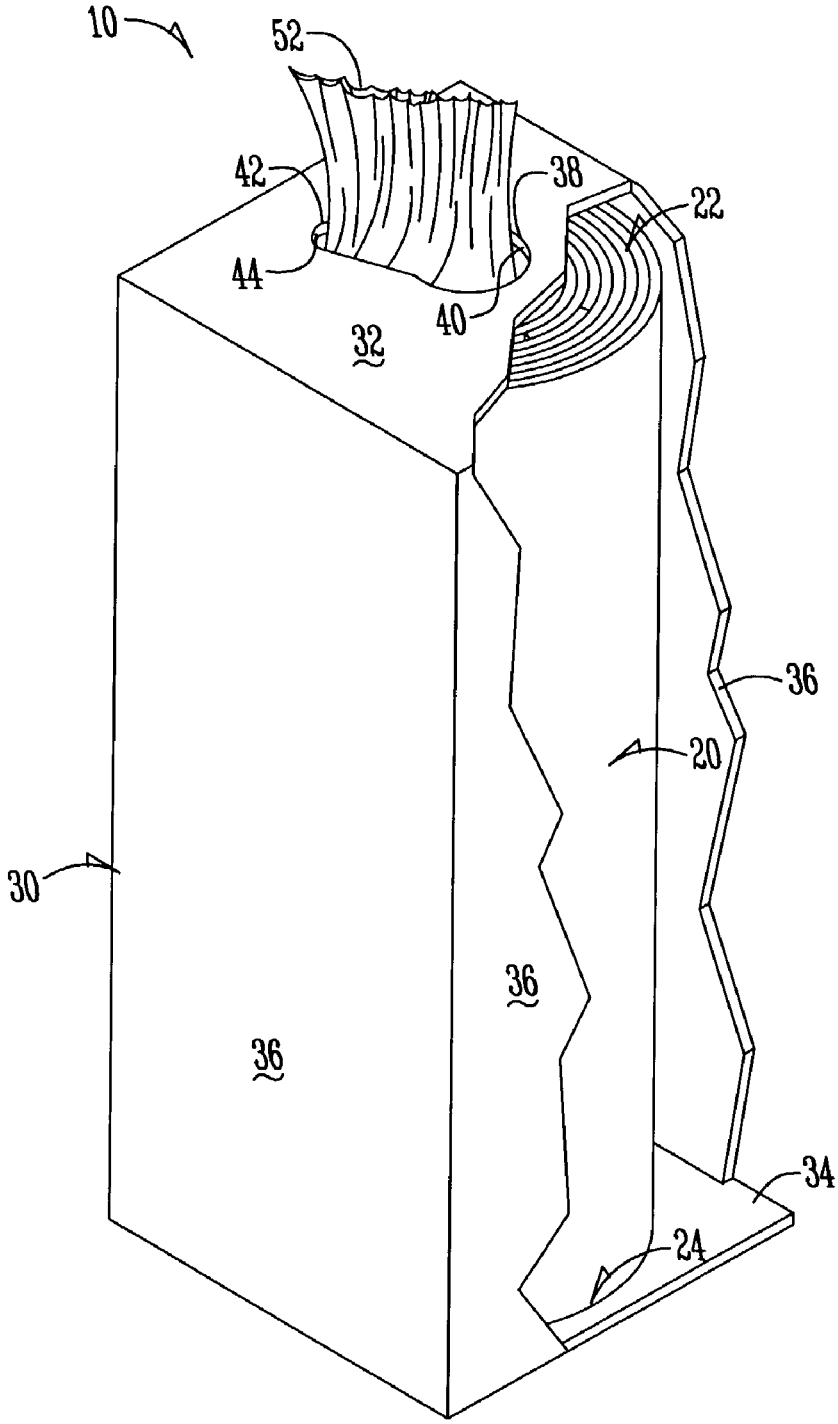
FIG. 3 is a perspective view of the axial center dispensing plastic sheet roll with a dispenser partially cut away to show the plastic sheet roll contained with the second plastic sheet pulled out.

The user, if finished dispensing first plastic sheet 50 may then take second plastic sheet 50, as seen in FIG. 3, and insert a section into the second opening 44 to hold the second plastic sheet 50 for ready dispensing at a later time.

In operation, the statically charged plastic sheet roll 20 may come to the consumer within a dispenser 30 having the first plastic sheet 50 pulled out exposing the first end 52. In this configuration, the user does not experience placing the first plastic sheet 50 into the dispenser opening 40. In this configuration, the first plastic sheet 50 has the first side 52 entirely exposed outside the box. This is in contrast to the roll 20 in FIG. 1, which exposes a dispensing side 56 of the plastic sheet 50. The user when pulling out the plastic sheet 50 pulls out the plastic sheet 50 for a distance equal to the length of the plastic sheet 50 as opposed to the distance equal to the length of the dispensing side 56 as opposed to the width of the first end 52.

In the drawings and specifications there has been set forth a preferred embodiment of the invention, and although specific terms are employed, these are used in a generic descriptive sense only and not for purposes of limitation. Changes in the form and the proportion of parts as well as in the substitution of equivalents are contemplated as circumstance may suggest or render expedient without departing from the spirit or scope of the invention in the following claims.

What is claimed is:

1. An axial center dispensing plastic sheet roll comprising: a plastic sheet roll of multiple, discrete, consecutive, plastic sheets arranged to form a roll, the roll arranged by overlapping opposite ends of the adjacent sheets, wherein the adjacent sheets are convolutedly wound on an inner sheet; and an electrostatic bond between the adjacent sheets, the electrostatic bond formed by an electrostatic charge applied to the overlapping ends of the adjacent sheets;

wherein the applied electrostatic bond is sufficient enough to resist separation of the adjacent sheets to aid in maintaining the integrity of the roll shape yet not sufficient enough to prevent separation of the innermost sheet; and when a force associated with grasping and pulling of the plastic sheets is greater than the applied electrostatic bond, the applied electrostatic bond facilitates removal of one sheet from the roll while moving the next consecutive sheet to a position partially outside of the innermost convolution.

2. The axial center dispensing plastic sheet roll of claim 1 wherein the plastic sheets are overlapped by at least about 4 inches.

3. The axial center dispensing plastic sheet roll of claim 1 wherein the plastic sheets are overlapped by about 6 inches.

4. The axial center dispensing plastic sheet roll of claim 1 in which the electrostatic charge is applied by a static pinner charging bar.

5. The axial center dispensing plastic sheet roll of claim 4 in which the static pinner charging bar is operating at least about 15 kilovolts.

6. The axial center dispensing plastic sheet roll of claim 4 in which the static pinner charging bar is operating at about 25 kilovolts.

7. The axial center dispensing plastic sheet roll of claim 1 wherein the plastic sheets are plastic bags.

8. The axial center dispensing plastic sheet roll product of claim 1 further comprises a dispensing container for housing the plastic roll and an opening within the dispensing container for dispensing the plastic sheets, the opening being notch-shaped to accommodate a portion of the next consecutive sheet.

9. A method of dispensing plastic sheets comprising the steps of:

providing a dispensing carton, a plastic sheet roll of multiple, discrete, consecutive plastic sheets arranged to form a roll, the roll arranged by overlapping opposite ends of the adjacent sheets, wherein the adjacent sheets are convolutedly wound on an inner sheet, the role positioned within the dispensing carton; an electrostatic bond formed between the adjacent sheets, the electrostatic bond formed by an electrostatic charge applied to the overlapping ends of the adjacent sheets;

wherein the applied electrostatic bond is sufficient enough to resist separation of the adjacent sheets to aid in maintaining the integrity of the roll shape yet not sufficient enough to prevent separation of the innermost sheet; and dispensing the plastic sheets from within the center of the roll in the axial direction such that when a force associated with grasping and pulling of the dispensing of the plastic sheets, the force is greater than the applied electrostatic bond, and the applied electrostatic bond facilitates removal of one sheet from the roll while moving the next consecutive sheet to a position partially outside of the innermost convolution.

10. The method of claim 9 further comprising the step of drawing the next consecutive sheet into a notch forming part of the opening such that the notch secures the next consecutive sheet for separating the next consecutive sheet from the one sheet.

11. An axial center dispensing plastic bag roll product comprising:

a dispensing carton;

a plastic sheet roll of multiple, discrete, consecutive, plastic sheets arranged to form a roll, the roll arranged by overlapping opposite ends of the adjacent sheets, wherein the adjacent sheets are convolutedly wound on an inner sheet, the roll positioned within the dispensing carton; and an electrostatic bond between the adjacent sheets, the electrostatic bond formed by an electrostatic charge applied to the overlapping ends of the adjacent sheets;

wherein the applied electrostatic bond is sufficient enough to resist separation of the adjacent sheets to aid in maintaining the integrity of the roll shape yet not sufficient enough to prevent separation of the innermost sheet; and when a force associated with grasping and pulling of the plastic sheets is greater than the applied electrostatic bond, the applied electrostatic bond facilitates removal of one sheet from the roll while moving the next consecutive sheet to a position partially outside of the innermost convolution.

12. The axial center dispensing plastic bag roll product of claim 11 wherein the plastic sheets are overlapped by at least about 4 inches.

13. The axial center dispensing plastic bag roll product of claim 11 wherein the plastic sheets are overlapped by about 6 inches.

* * * * *